US009275778B2

(12) United States Patent
Ozeki et al.

(10) Patent No.: US 9,275,778 B2
(45) **Date of Patent: *Mar. 1, 2016**

(54) PERMANENT MAGNET AND METHOD FOR MANUFACTURING THE SAME

(75) Inventors: Izumi Ozeki, Ibaraki (JP); Katsuya Kume, Ibaraki (JP); Junichi Nakayama, Ibaraki (JP); Yuuki Fukuda, Ibaraki (JP); Toshinobu Hoshino, Ibaraki (JP); Tomokazu Horio, Ibaraki (JP)

(73) Assignee: NITTO DENKO CORPORATION, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/933,180

(22) PCT Filed: Mar. 17, 2009

(86) PCT No.: PCT/JP2009/055168

§ 371 (c)(1),
(2), (4) Date: Sep. 17, 2010

(87) PCT Pub. No.: WO2009/116532

PCT Pub. Date: Sep. 24, 2009

(65) Prior Publication Data

US 2011/0018664 A1 Jan. 27, 2011

(30) Foreign Application Priority Data

Mar. 18, 2008 (JP) ..... 2008-069383

(51) Int. Cl.
*H01F 1/057* (2006.01)
*H01F 1/055* (2006.01)
(Continued)

(52) U.S. Cl.
CPC ..... *H01F 1/0572* (2013.01); *H01F 1/0552* (2013.01); *H01F 41/0266* (2013.01); *H01F 41/0293* (2013.01); *H01F 1/0557* (2013.01); *H01F 1/0577* (2013.01); *H01F 41/16* (2013.01)

(58) Field of Classification Search
CPC ..... H01F 1/057; H01F 1/0575
See application file for complete search history.

(56) References Cited

U.S. PATENT DOCUMENTS 4,762,574 A * 8/1988 Ghandehari ..... 148/103
5,733,580 A 3/1998 Ikuma et al.
(Continued)

FOREIGN PATENT DOCUMENTS

CN 1056370 A 11/1991
EP 2 267 733 A1 12/2010
(Continued)

OTHER PUBLICATIONS

Machine Translation of Japanese Patent Document No. 2005-191282. (Jul. 14, 2005).*
(Continued)

*Primary Examiner* — Jie Yang
*Assistant Examiner* — Xiaowei Su
(74) *Attorney, Agent, or Firm* — Sughrue Mion, PLLC

(57) ABSTRACT

The present invention relates to a permanent magnet obtained by wet-mixing a Dy compound or a Tb compound with a magnet raw material to coat a surface of the magnet raw material with the Dy compound or the Tb compound, and sintering a green sheet obtained by mixing the resulting magnet raw material with a resin binder and molding the resulting mixture. Since the present invention has the above-mentioned constitution, it becomes possible to sufficiently improve coercive force by Dy or Tb while decreasing the amount of Dy or Tb used. Further, it can be prevented that Dy or Tb is solid-solutionized in magnet particles to decrease residual magnetization.

2 Claims, 4 Drawing Sheets

(51) Int. Cl.
*H01F 41/02* (2006.01)
*H01F 41/16* (2006.01)

(56) References Cited

U.S. PATENT DOCUMENTS

| | | | | |
|---|---|---|---|---|
| 7,244,318 | B2 | 7/2007 | Sekino et al. | |
| 8,480,816 | B2 * | 7/2013 | Ozeki et al. | 148/101 |
| 2002/0149458 | A1 * | 10/2002 | Fujiwara et al. | 336/110 |
| 2003/0019326 | A1 | 1/2003 | Han et al. | |
| 2004/0187963 | A1 | 9/2004 | Tayu et al. | |
| 2004/0207500 | A1 * | 10/2004 | Fujiwara et al. | 336/178 |
| 2005/0133117 | A1 * | 6/2005 | Tayu et al. | 148/105 |
| 2006/0231165 | A1 | 10/2006 | Kato et al. | |
| 2008/0054738 | A1 | 3/2008 | Komuro et al. | |
| 2011/0012700 | A1 * | 1/2011 | Ozeki et al. | 335/302 |
| 2011/0043311 | A1 * | 2/2011 | Ozeki et al. | 335/302 |
| 2012/0181475 | A1 | 7/2012 | Ozeki et al. | |
| 2012/0181476 | A1 | 7/2012 | Ozeki et al. | |
| 2012/0187326 | A1 | 7/2012 | Ozeki et al. | |
| 2012/0187329 | A1 | 7/2012 | Ozeki et al. | |
| 2012/0187612 | A1 | 7/2012 | Ozeki et al. | |

FOREIGN PATENT DOCUMENTS

| | | | | |
|---|---|---|---|---|
| JP | 03-214608 | | * | 9/1991 |
| JP | 06-158238 | A | | 6/1994 |
| JP | 07-086015 | A | | 3/1995 |
| JP | 08-08111 | A | | 1/1996 |
| JP | 2000-096102 | A | | 4/2000 |
| JP | 2001-20065 | A | | 1/2001 |
| JP | 3298219 | B2 | | 4/2002 |
| JP | 2003-007520 | A | | 1/2003 |
| JP | 2003282312 | A | * | 10/2003 |
| JP | 2004281873 | A | * | 10/2004 |
| JP | 2004-319955 | | | 11/2004 |
| JP | 2005-39089 | A | | 2/2005 |
| JP | 2005-97697 | A | | 4/2005 |
| JP | 2005-191187 | A | | 7/2005 |
| JP | 2005-191282 | A | | 7/2005 |
| JP | 2005-197299 | A | | 7/2005 |
| JP | 2006-286819 | A | | 10/2006 |
| JP | 2007-191787 | A | | 8/2007 |
| JP | 2008-60183 | A | | 3/2008 |
| JP | 2009-224670 | A | | 10/2009 |
| KR | 10-2002-0042516 | A | | 6/2002 |
| WO | 2009/116532 | A1 | | 9/2009 |

OTHER PUBLICATIONS

Machine translation of JP2004281873. Oct. 2004.*

Machine translation of JP2003-282312A. Oct. 2003.*

European Search Report issued in corresponding European patent application No. 09722755.7 on Jun. 9, 2011.

International Search Report (PCT/ISA/210) for PCT/JP2009/055168, 5 pages, dated Jun. 23, 2009.

Written Opinion (PCT/ISA/237) for PCT/JP2009/055168, 5 pages, dated Jun. 23, 2009.

Communication dated Feb. 16, 2012 from the State Intellectual Property Office of the People's Republic of China in counterpart Chinese application No. 200980109640.3.

Communication issued Aug. 31, 2012 by the State Intellectual Property Office of the People's Republic of China in counterpart Chinese Application No. 200980109640.3.

Office Action dated Apr. 9, 2013 issued by the State Intellectual Property Office of P.R. China in corresponding Chinese Patent Application No. 200980109640.3.

Office Action mailed Feb. 26, 2013 issued by the Japanese Patent Office in corresponding Japanese Patent Application No. 2008-069383.

Japanese Office Action issued Sep. 3, 2013, in corresponding Application No. 2008-069383.

Communication dated Aug. 28, 2013 from the State Intellectual Property Office of P.R. China in a counterpart application No. 200980109640.3.

Office Action, dated Feb. 8, 2014, issued by the State Intellectual Property Office of the People's Republic of China in counterpart Chinese Application No. 200980109640.3.

Communication from the Korean Intellectual Property Office dated Nov. 27, 2014, in a counterpart Korean application No. 10-2010-7020904.

Notification of Reexamination dated Apr. 3, 2015 issued by Patent Reexamination Board of the Chinese Patent Office in counterpart 200980109640.3.

Notice of Preliminary Rejection dated Jun. 18, 2014, issued by the Korean Intellectual Property Office in counterpart Korean Application No. 10-2010-7020904.

Supplementary European Search Report issued in Application No. 11765494.7, which corresponds to U.S. Appl. No. 13/499,434, dated Nov. 7, 2012.

* cited by examiner

PERMANENT MAGNET AND METHOD FOR MANUFACTURING THE SAME

TECHNICAL FIELD

The present invention relates to a permanent magnet and a method for manufacturing the permanent magnet.

BACKGROUND ART

In recent years, a reduction in size and weight, an increase in power and an increase in efficiency have been required for permanent magnetic motors used in hybrid cars, hard disk drives or the like. In particular, with recent requirement for a reduction in size of the hard disk drives, a further reduction in size and thickness has been required for voice coil motors (hereinafter referred to as VCMs) used for head driving of the hard disk drives as shown in patent document 1.

Then, in realizing the reduction in size and thickness in the above-mentioned VCMs, a reduction in film thickness and further improvement in magnetic characteristics have been required for permanent magnets buried in the VCMs. Incidentally, as the permanent magnets, there are ferrite magnets, Sm—Co-based magnets, Nd—Fe—B-based magnets, $Sm_2Fe_{17}N_x$-based magnets and the like. In particular, Nd—Fe—B-based magnets having high coercive force are used as the permanent magnets for the permanent magnet motors.

Here, as a method for manufacturing the permanent magnet used in the permanent magnet motor, a powder sintering method is generally used. In the powder sintering method as used herein, a raw material is first pulverized with a jet mill (dry pulverization) to produce a magnet powder as shown in FIG. 6. Thereafter, the magnet powder is placed in a mold, and press molded to a desired shape while applying a magnetic field from the outside. Then, the solid magnet powder molded to the desired shape is sintered at a predetermined temperature (for example, 1100° C. in the case of the Nd—Fe—B-based magnet), thereby manufacturing the permanent magnet.

Patent Document 1: JP-A-2006-286819 (Page 2, Page 3, FIG. 4)

DISCLOSURE OF THE INVENTION

Here, when a Nd-based magnet such as the Nd—Fe—B-based magnet is used in the permanent magnetic motor, Dy (dysprosium) is added to further improve coercive force of the magnet, in order to improve the output of the motor. This is caused by that Dy is solid-solutionized in magnet particles. However, in a conventional method for manufacturing the Nd-based magnet, a large amount of Dy becomes necessary for solid-solutionizing Dy in the magnet particles to sufficiently achieve improvement in coercive force of the magnet. For example, the amount of Dy required to be added has been from 20 to 30 wt % based on Nd.

However, Dy is a rare metal, and the locality thereof is limited, so that it is desirable to reduce the amount of Dy used, based on Nd, as much as possible.

Further, when Dy added as described above is solid-solutionized in the magnet particles, this contributes to a decrease in residual magnetization of the magnet.

Accordingly, a technique for largely improving the coercive force of the magnet by addition of a slight amount of Dy without a decrease in residual magnetization has been desired.

The invention has been made in order to solve the above-mentioned conventional problems, and an object of the invention is to provide a permanent magnet in which it becomes possible to unevenly distribute a slight amount of Dy added in grain boundaries of magnet particles, thereby being able to sufficiently improve the residual magnetization and coercive force by Dy while decreasing the amount of Dy used, and a method for manufacturing the permanent magnet.

Namely, the present invention relates to the following items (1) to (5).

(1) A permanent magnet obtained by wet-mixing a Dy compound or a Tb compound with a magnet raw material to coat a surface of the magnet raw material with the Dy compound or the Tb compound, and sintering a green sheet obtained by mixing the resulting magnet raw material with a resin binder and molding the resulting mixture.

(2) The permanent magnet according to (1), in which the Dy compound or the Tb compound is unevenly distributed in a grain boundary of the magnet raw material after sintering.

(3) The permanent magnet according to (1) or (2), in which the Dy compound or the Tb compound is contained in an amount of from 0.01 to 8 wt %.

(4) A method for manufacturing a permanent magnet, the method including:

a step of wet-mixing a Dy compound or a Tb compound with a magnet raw material in a solvent to coat a surface of the magnet raw material with the Dy compound or the Tb compound;

a step of adding a resin binder to the magnet raw material coated with the Dy compound or the Tb compound;

a step of producing a slurry by kneading the magnet raw material and the resin binder;

a step of molding the slurry into a sheet form to prepare a green sheet; and a step of sintering the green sheet.

(5) The method for manufacturing a permanent magnet according to (4), in which the Dy compound or the Tb compound is contained in an amount of from 0.01 to 8 wt %.

According to the permanent magnet having the constitution of the above (1), the permanent magnet is constituted by the magnet obtained by wet-mixing the Dy compound or the Tb compound with the magnet raw material to coat the surface of the magnet raw material with the Dy compound or the Tb compound, and sintering the green sheet obtained by mixing the resulting magnet raw material with the resin binder and molding the resulting mixture. Accordingly, it becomes possible to sufficiently improve the coercive force by Dy or Tb while decreasing the amount of Dy or Tb used. Further, it can be prevented that Dy or Tb is solid-solutionized in the magnet particles to decrease the residual magnetization.

Further, according to the permanent magnet of the above (2), the Dy compound or the Tb compound is unevenly distributed in the grain boundary of the magnet raw material after sintering, so that it becomes possible to sufficiently improve the residual magnetization and coercive force by Dy or Tb while decreasing the amount of Dy or Tb used.

Furthermore, according to the permanent magnet of the above (3), the content of the above-mentioned Dy compound or Tb compound is from 0.01 to 8 wt %, so that it becomes possible to sufficiently improve the residual magnetization and coercive force by Dy or Tb while decreasing the amount of Dy or Tb used.

In addition, according to the method for manufacturing the permanent magnet of the above (4), the permanent magnet is manufactured by wet-mixing the Dy compound or the Tb compound with the magnet raw material in the solvent to coat the surface of the magnet raw material with the Dy compound or the Tb compound, forming the green sheet from the slurry produced from the magnet raw material, and sintering the green sheet. For this reason, it becomes possible to unevenly distribute the Dy compound or the Tb compound in the grain boundaries of the magnet particles. Accordingly, even when the amount of Dy or Tb used is decreased, it becomes possible to sufficiently improve the residual magnetization and coercive force of the magnet by a slight amount of Dy or Tb.

Moreover, according to the method for manufacturing the permanent magnet of the above (5), the content of the above-mentioned Dy compound or Tb compound is from 0.01 to 8 wt %, so that it becomes possible to sufficiently improve the residual magnetization and coercive force by Dy or Tb while decreasing the amount of Dy or Tb used.

DESCRIPTION OF REFERENCE NUMERALS AND SIGNS

1: Permanent magnet
41: Slurry
42: Green sheet

BEST MODE FOR CARRYING OUT THE INVENTION

A specific embodiment of a permanent magnet and a method for manufacturing the permanent magnet according to the invention will be described below in detail with reference to the drawings.

Constitution of Permanent Magnet

First, a constitution of a permanent magnet 1 will be described using FIGS. 1 to 4. Incidentally, in this embodiment, particularly, an explanation is given taking the permanent magnet 1 buried in a VCM as an example.

Figure 1:
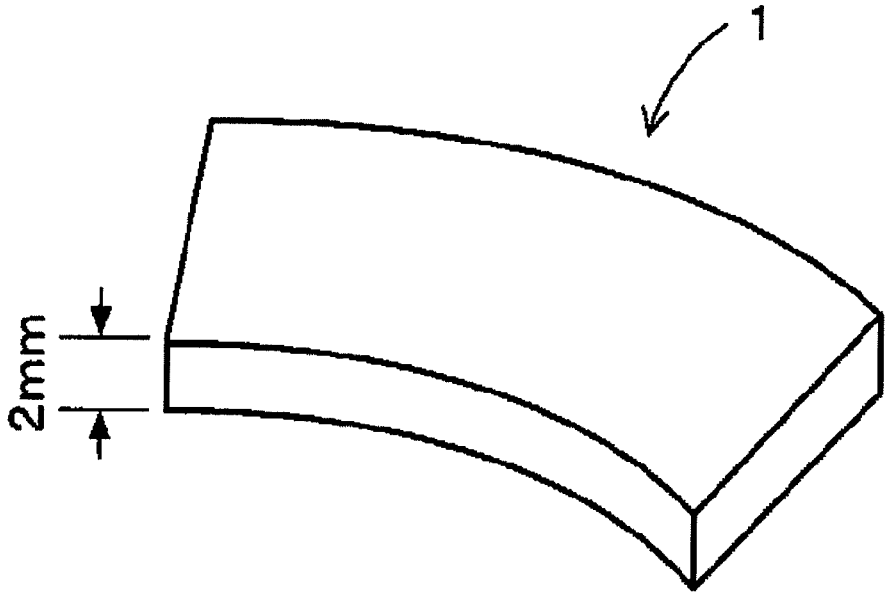
FIG. 1 is an overall view showing a permanent magnet according to the present embodiment.

The permanent magnet 1 according to this embodiment is a Nd—Fe—B-based magnet. Further, Dy (dysprosium) for increasing the coercive force of the permanent magnet 1 is added. Incidentally, the contents of respective components are regarded as Nd: 27 to 30 wt %, Dy (or Tb): 0.01 to 8 wt %, B: 1 to 2 wt %, and Fe (electrolytic iron): 60 to 70 wt %. Furthermore, the permanent magnet 1 is constituted from a fan-shaped and thin film-like magnet as shown in FIG. 1. FIG. 1 is an overall view showing the permanent magnet 1 according to this embodiment.

The permanent magnet 1 as used herein is a thin film-like permanent magnet having a thickness of 0.1 to 2 mm (2 mm in FIG. 1), and is prepared by sintering a green sheet molded from a Nd magnet powder in a slurry state as described later.

Figure 2:
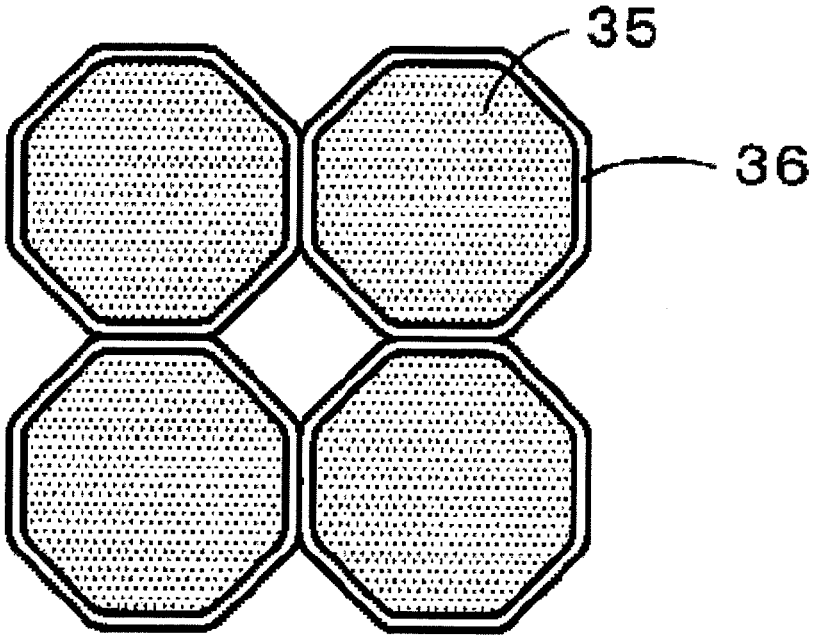
FIG. 2 is an enlarged view showing Nd magnet particles constituting a permanent magnet.

Further, in the permanent magnet 1 according to this embodiment, the coercive force of the permanent magnet 1 is improved by coating surfaces of Nd particles 35 constituting the permanent magnet 1 with Dy layers 36 as shown in FIG. 2. FIG. 2 is an enlarged view showing the Nd magnet particles constituting the permanent magnet 1.

Figure 3:
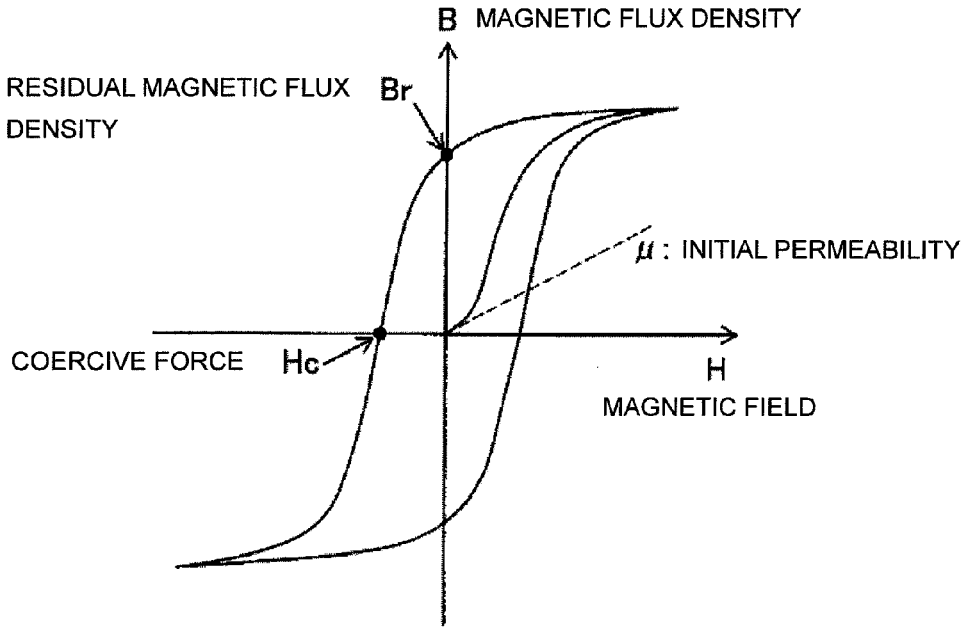
FIG. 3 is a graph showing a hysteresis curve of a ferromagnetic body
Figure 4:
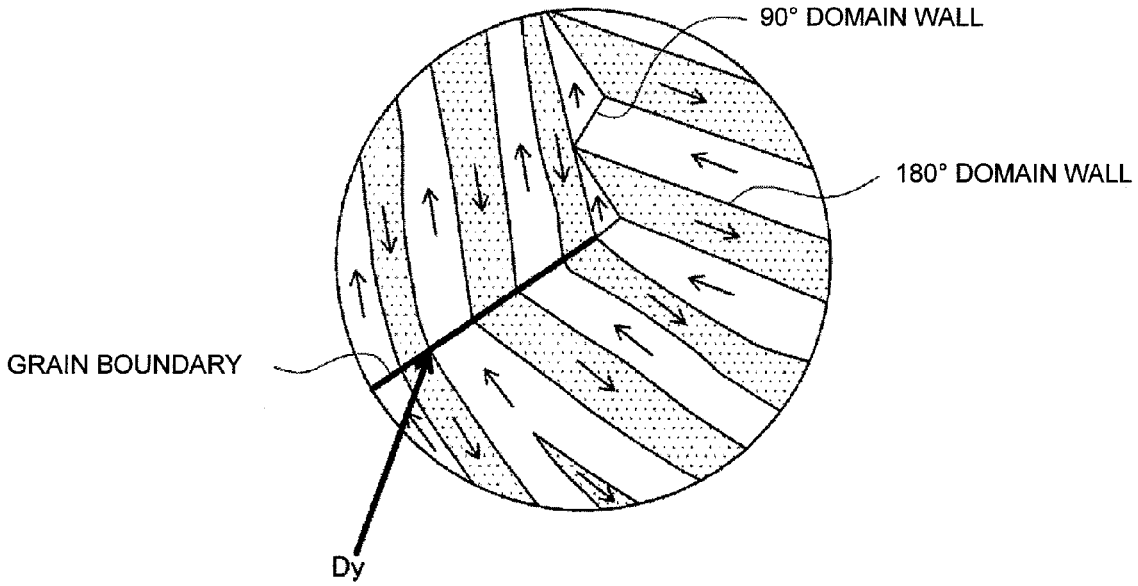
FIG. 4 is a schematic view showing a magnetic domain structure of a ferromagnetic body.

A mechanism of improving the coercive force of the permanent magnet 1 with the Dy layers 36 will be described below using FIG. 3 and FIG. 4. FIG. 3 is a graph showing a hysteresis curve of a ferromagnetic body, and FIG. 4 is a schematic view showing a magnetic domain structure of the ferromagnetic body.

As shown in FIG. 3, the coercive force of the permanent magnet is the intensity of a magnetic field necessary for making magnetic polarization zero (that is to say, for magnetization reversal) when the magnetic field is applied from a magnetized state in the opposite direction. Accordingly, if the magnetization reversal can be inhibited, high coercive force can be obtained. Incidentally, magnetization processes of a magnetic body include rotational magnetization based on rotation of magnetic moment and domain wall displacement in which domain walls (consisting of a 90° domain wall and a 180° domain wall) as boundaries of magnetic domains move.

Here, in this embodiment, when the magnet powder is finely pulverized by wet pulverization as described later, slight amounts (for example, 0.01 to 8 wt % based on the magnet powder (the amount of Dy added based on Nd, being taken as weight conversion of Dy distribution particularly when a Dy compound is added) of the Dy compound and a dispersing agent are added. This causes the Dy compound to be uniformly adhered to the particle surfaces of the Nd magnet particles by wet dispersion to form the Dy layers 36 shown in FIG. 2, when the Dy compound-added magnet powder is sintered thereafter. As a result, Dy is unevenly distributed in a boundary face of the magnet particle as shown in FIG. 4, thereby being able to improve the coercive force of the permanent magnet 1.

Further, in this embodiment, when the green sheet obtained by wet-mixing the Dy compound with the magnet raw material in a solvent is sintered under proper sintering conditions, Dy can be prevented from being diffused and penetrated (solid-solutionized) into the magnet particles 35. Here, it is known that the diffusion and penetration of Dy into the magnet particles 35 decreases the residual magnetization (magnetization at the time when the intensity of the magnetic field is made zero) of the magnet. Accordingly, in this embodiment, the residual magnetization of the permanent magnet 1 can be prevented from being decreased.

Incidentally, the Dy layer 36 is not required to be a layer composed of only the Dy compound, and may be a layer composed of a mixture of Dy and Nd. Further, a Tb (terbium) compound may be added in place of the Dy compound, whereby it becomes possible to similarly improve the residual magnetization of the permanent magnet 1. When Tb is added, layers of the Tb compound are similarly formed on the surfaces of the Nd magnet particles 35, and the residual magnetization of the permanent magnet 1 can be further improved by forming the Tb layers.

Method for Manufacturing Permanent Magnet

Figure 5:
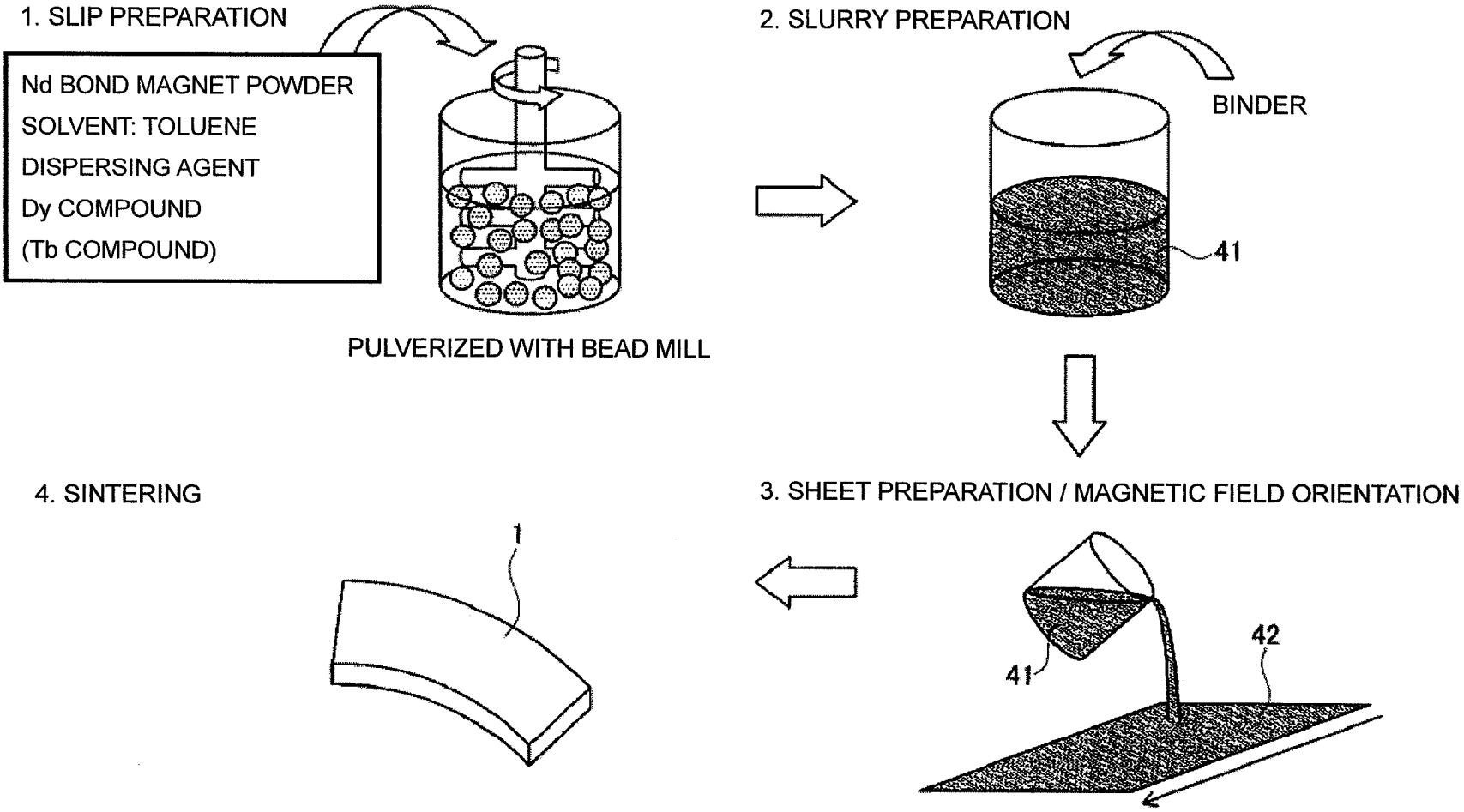
FIG. 5 is an explanatory view showing a manufacturing process of the permanent magnet according to the present embodiment.
Figure 6:
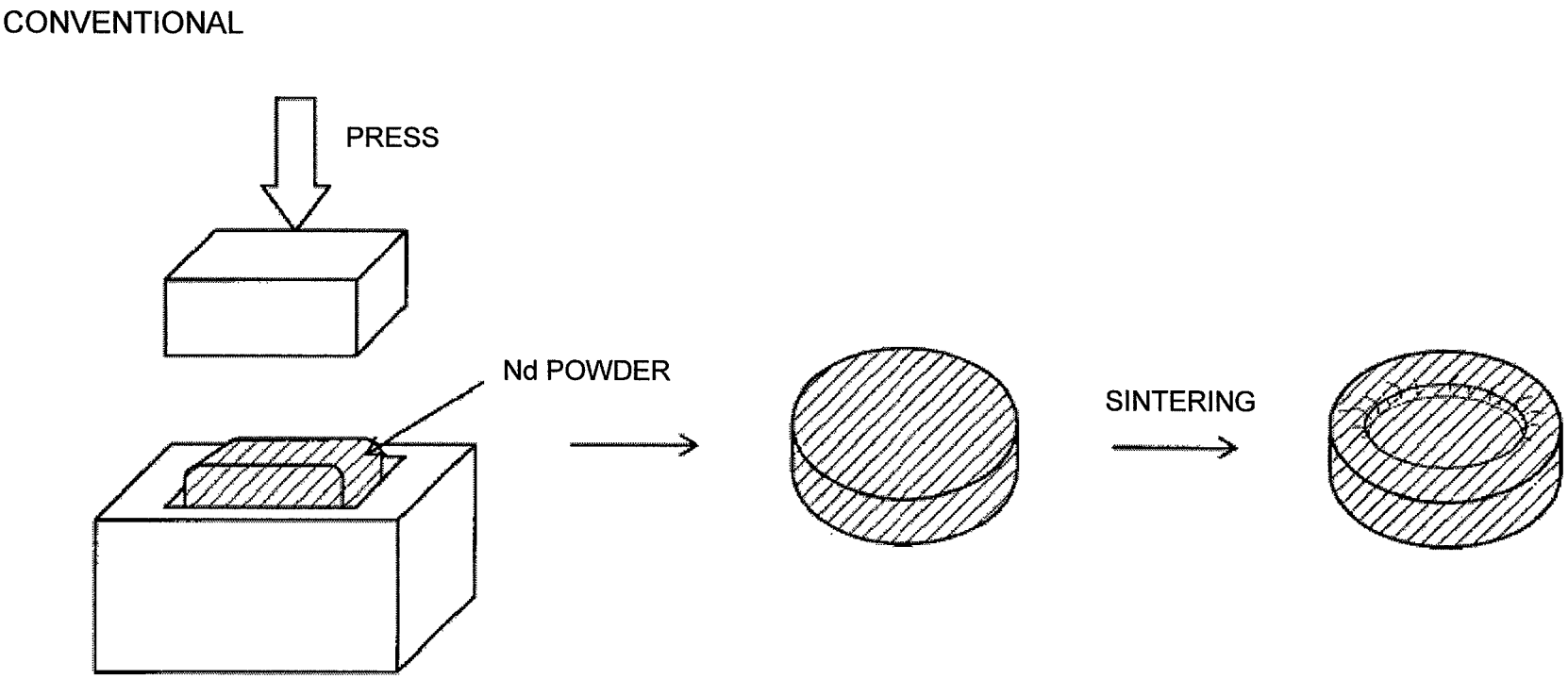
FIG. 6 is an explanatory view showing a manufacturing process of a conventional permanent magnet.

A method for manufacturing the permanent magnet 1 according to this embodiment will be described below using FIG. 5. FIG. 5 is an explanatory view showing a manufacturing process of the permanent magnet 1 according to this embodiment.

First, an ingot including 27 to 30 wt % of Nd, 60 to 70 wt % of Fe and 1 to 2 wt % of B is produced. Thereafter, the ingot is crudely pulverized to a size of about 200 μm with a stamp mill, a crusher or the like. Then, the crudely pulverized magnet powder is finely pulverized to a size of about 0.3 to 5 μm by a wet method using a bead mill, and the magnet powder is dispersed in a solution to prepare a slip. Incidentally, in the wet pulverization, 4 kg of toluene based on 5 kg of the magnet powder is used as a solvent, and 0.05 kg of a phosphate-based dispersing agent is further added as a dispersing agent. Further, during the wet pulverization, 0.01 to 8 wt % of the Dy compound is added to the magnet powder, thereby dispersing the Dy compound in the solvent together with the magnet powder. Incidentally, detailed dispersing conditions are as follows:

Dispersing device: bead mill

Dispersing medium: zirconia beads

Here, a substance soluble in the solvent of the slurry is preferably used as the Dy compound added. For example, a Dy-containing organic material, more particularly a dysprosium cation-containing organic acid salt (an aliphatic carboxylate, an aromatic carboxylate, an alicyclic carboxylate, an alkyl aromatic carboxylate or the like), a dysprosium cation-containing organic complex (an acetylacetonate, a phthalocyan complex, a merocyan complex or the like) and an organic metal compound other than the above may be mentioned.

Further, it also becomes possible to uniformly adhere Dy or the Dy compound to the surface of the Nd magnet particle by adding Dy or the Dy compound pulverized into fine particles, at the time of wet dispersion, and uniformly dispersing the fine particles, even when it is insoluble in the solvent.

Furthermore, there is no particular limitation on the solvent used for pulverization, and there can be used an alcohol such as isopropyl alcohol, ethanol or methanol, a lower hydrocarbon such as pentane or hexane, an aromatic compound such as benzene, toluene or xylene, a ketone, a mixture thereof or the like. In particular, isopropyl alcohol or the like is preferred.

After dispersion of the magnet powder, a resin binder is added to and mixed with the slip prepared. Subsequently, the magnet powder and the resin binder are kneaded to produce a slurry 41. Incidentally, a material used as the resin binder is not particularly limited, and may be each of various thermoplastic resin single substances or mixtures thereof, or various thermosetting resin single substances or mixtures thereof. Physical properties, natures and the like of the respective ones may be any, as long as they are within the range in which desired characteristics are obtained. For example, a methacrylic resin may be mentioned.

Subsequently, a green sheet 42 is formed from the slurry 41 produced. A method for forming the green sheet 42 can be performed, for example, by a method of coating a supporting substrate such as a separator as needed with the produced slurry 41 by an appropriate system, followed by drying, or the like. Incidentally, the coating system is preferably a system excellent in layer thickness controllability, such as a doctor blade method. Further, it is preferred that a defoaming treatment is sufficiently performed so that no air bubbles remain in a developed layer, by combined use of a defoaming agent or the like. Incidentally, detailed coating conditions are as follows:

Coating system: doctor blade

Gap: 1 mm

Supporting substrate: silicone-treated polyester film

Drying conditions: 130° C.×30 min after 90° C.×10 min

Further, a pulsed field is applied to the green sheet 42 coated on the supporting substrate, in a direction crossing to a transfer direction, thereby orientating the magnetic field in a desired direction. Incidentally, it is necessary to determine the direction in which the magnetic field is orientated, taking into consideration the magnetic field direction required for the permanent magnet 1 molded from the green sheet 42.

Then, the green sheet 42 formed from the slurry 41 is divided into a desired product shape (for example, in this embodiment, the fan shape shown in FIG. 1). Thereafter, sintering is performed at 1,100° C. for about 1 hour. Incidentally, the sintering is performed under an Ar or vacuum atmosphere, and as a result of the sintering, the permanent magnet 1 composed of a sheet-like magnet is manufactured.

As described above, in the permanent magnet 1 and the method for manufacturing the permanent magnet 1 according to this embodiment, the magnet raw material including 27 to 30 wt % of Nd, 60 to 70 wt % of Fe and 1 to 2 wt % of B is pulverized by the wet pulverization, and 0.01 to 8 wt % of the Dy compound and the dispersing agent is added to the magnet powder during the wet pulverization, thereby dispersing the Dy compound in the solvent together with the magnet raw material. Thereafter, the resin binder is added to the solvent, and the magnet powder and the resin binder are kneaded to produce the slurry 41. Then, the green sheet 42 obtained by molding the produced slurry 41 into the sheet form is sintered, thereby manufacturing the permanent magnet 1. Therefore, when the Dy-added magnet powder is sintered, the Dy compound is uniformly adhered to the particle surfaces of the Nd magnet particles 35 by wet dispersion, and it becomes possible to unevenly distribute the Dy compound only in the grain boundaries of the magnet particles. Accordingly, even when the amount of Dy used is decreased, Dy can be selectively unevenly distributed in the grain boundaries of the magnet particles, and it becomes possible to sufficiently improve the coercive force of the magnet by a slight amount of Dy.

Further, when the above-mentioned green sheet 42 is sintered under proper sintering conditions, Dy can be prevented from being solid-solutionized into the magnet particles. Accordingly, the residual magnetization of the permanent magnet can be prevented from being decreased.

Furthermore, it becomes possible to further improve the coercive force by addition of a slight amount of Dy particularly to the Nd-based magnet which can secure high coercive force.

In addition, the content of Dy contained in the magnet powder is adjusted to 0.01 to 8 wt %, so that it becomes possible to sufficiently improve the coercive force of the magnet by Dy, even when the amount added is less than one-third the conventional amount of Dy added.

Incidentally, the invention should not be construed as being limited to the above-mentioned example, and various improvements and modifications are of course possible within the range not departing from the gist of the invention.

For example, in this embodiment, as the method for dispersing the magnet powder and the Dy compound in the solvent, the crudely pulverized magnet powder is wet-pulverized in the solvent together with the Dy compound, thereby dispersing them in the solvent, as shown in FIG. 5. However, it is also possible to disperse them by the following method.

(1) First, the crudely pulverized magnet powder is finely pulverized to a size of about 0.3 to 5 μm by dry pulverization using a ball mill, a jet mill or the like.

(2) Then, the finely pulverized magnet powder is added to the solvent, and allowed to be uniformly dispersed in the solvent. In that case, the dispersing agent and the Dy compound are also added to the solvent.

(3) The magnet powder and the resin powder dispersed in the solvent are kneaded to produce the slurry 41.

It becomes possible to manufacture the permanent magnet having the same constitution as in this embodiment by hereinafter performing the same treatment as in this embodiment.

Further, in this embodiment, description is made taking the permanent magnet buried in the VCM as an example. However, it is also of course possible to be applied to the permanent magnet buried in a permanent magnet motor such as a vibration motor mounted on a cellular phone, a driving motor mounted on a hybrid car or a spindle motor for rotating a disk of a hard disk drive.

Furthermore, the pulverizing conditions, kneading conditions and sintering conditions of the magnet powder should not be construed as being limited to the conditions described in the above-mentioned example.

While the invention has been described in detail with reference to the specific embodiment thereof, it will be apparent to one skilled in the art that various changes and modifications can be made therein without departing from the spirit and scope of the invention.

Incidentally, this application is based on Japanese Patent Application No. 2008-069383 filed on Mar. 18, 2008, the entire contents of which are incorporated herein by reference.

Further, all references cited herein are incorporated by reference in their entirety.

INDUSTRIAL APPLICABILITY

According to a permanent magnet of the invention, the permanent magnet is constituted by a magnet obtained by wet-mixing a Dy compound or a Tb compound with a magnet raw material to coat a surface of the magnet raw material with the Dy compound or the Tb compound, and sintering a green sheet obtained by mixing the resulting magnet raw material with a resin binder and molding the resulting mixture. Accordingly, it becomes possible to sufficiently improve coercive force by Dy or Tb while decreasing the amount of Dy or Tb used. Further, it can be prevented that Dy or Tb is solid-solutionized in magnet particles to decrease residual magnetization.

The invention claimed is:

1. A method for manufacturing a permanent magnet, said method comprising:

a step of wet-mixing a Dy compound precursor or a Tb compound precursor with a magnet raw material in the form of a powder in a solvent;

a step of adding a resin binder to the magnet raw material coated with the Dy compound precursor or the Tb compound precursor;

a step of producing a slurry by kneading the magnet raw material and the resin binder;

a step of molding the slurry into a sheet form to prepare a green sheet; and a step of sintering the green sheet, wherein the permanent magnet is a Nd—Fe—B-based permanent magnet comprising 27 to 30 weight % of Nd, 60 to 70 wt % of Fe, and 1 to 2 weight % of B, and the Dy compound or the Tb compound is formed at the grain boundaries, wherein the Dy compound precursor or Tb compound precursor is soluble in the solvent, and wherein the Dy compound precursor or Tb compound precursor is an organic acid salt, an organic complex, or an organic metal compound.

2. The method for manufacturing a permanent magnet according to claim 1, wherein the Dy compound or the Tb compound is contained in an amount of from 0.01 to 8 wt %.

* * * * *